US005899966A

United States Patent [19]

Matsumoto et al.

[11] Patent Number: 5,899,966

[45] Date of Patent: May 4, 1999

[54] SPEECH DECODING METHOD AND APPARATUS TO CONTROL THE REPRODUCTION SPEED BY CHANGING THE NUMBER OF TRANSFORM COEFFICIENTS

[75] Inventors: Jun Matsumoto; Masayuki Nishiguchi; Shiro Omori, all of Kanagawa; Kazuyuki Iijima, Saitama, all of Japan

[73] Assignee: Sony Corporation, Tokyo, Japan

[21] Appl. No.: 08/736,211

[22] Filed: Oct. 25, 1996

[30] Foreign Application Priority Data

Oct. 26, 1995 [JP] Japan ..... 7-279409

[51] Int. Cl.[6] ..... G10L 3/02

[52] U.S. Cl. ..... 704/205; 704/203; 704/268

[58] Field of Search ..... 704/500–504, 704/204, 203, 265, 268, 230, 206, 205

[56] References Cited

U.S. PATENT DOCUMENTS

| | | | |
|---|---|---|---|
| 4,435,832 | 3/1984 | Asada et al. . | |
| 4,776,014 | 10/1988 | Zinser | 704/262 |
| 4,866,777 | 9/1989 | Mulla et al. | 704/206 |
| 5,179,626 | 1/1993 | Thomson | 704/200 |
| 5,226,083 | 7/1993 | Taguchi | 704/219 |
| 5,305,421 | 4/1994 | Li | 704/219 |
| 5,349,549 | 9/1994 | Tsutsui | 364/725.03 |
| 5,353,374 | 10/1994 | Wilson et al. | 704/226 |
| 5,579,437 | 11/1996 | Fette | 704/262 |
| 5,687,281 | 11/1997 | Beerends | 704/203 |

FOREIGN PATENT DOCUMENTS

| | | | |
|---|---|---|---|
| 0 230 001 A1 | 7/1987 | European Pat. Off. . | |
| 0 393 614 A1 | 10/1990 | European Pat. Off. . | |
| 0 482 699 A2 | 4/1992 | European Pat. Off. | G10L 9/14 |
| 0 616 315 A1 | 9/1994 | European Pat. Off. . | |
| 2060321 | 4/1981 | United Kingdom . | |
| 9304467 | 3/1994 | WIPO . | |
| 9530983 | 11/1995 | WIPO . | |

OTHER PUBLICATIONS

R. Ansari, *Pitch Modification of Speech Using a Low Sensitivity Inverse Filter Approach,* vol. 5, No. 3, pp. 60–62 (Mar. 1998).

Eric Moulines and Francis Charpentier, "Pitch–Synchronous Waveform Processing Techniques for Text–to Speech Synthesis Using Diphones," Speech Communications, vol. 9, 1990, pp. 453–467, 1990.

*Primary Examiner*—David R. Hudspeth
*Assistant Examiner*—Donald L. Storm
*Attorney, Agent, or Firm*—Jay H. Maioli

[57] ABSTRACT

A signal decoding method and apparatus in which the speech signal reproducing speed is controlled without changing the phoneme or the pitch, in which the apparatus has a data number convertor for converting the number of orthogonal transform coefficients entering a transmission signal input terminal from N to M, an inverse orthogonal transform unit for inverse orthogonal-transforming the M number of the orthogonal transform coefficients obtained by the data number convertor, and a linear predictive coding synthesis filter for performing predictive synthesis based on the short-term prediction residuals obtained by the inverse orthogonal transform unit. For an input signal, short-term prediction residuals are found and are orthogonally transformed to form the orthogonal transform coefficients at a rate of N coefficients per transform unit. The frequency positions of the N transform coefficients may be rearranged to M values by M/N or by oversampling to change N to M. A portable radio terminal embodying the invention is described.

11 Claims, 5 Drawing Sheets

SPEECH DECODING METHOD AND APPARATUS TO CONTROL THE REPRODUCTION SPEED BY CHANGING THE NUMBER OF TRANSFORM COEFFICIENTS

BACKGROUND OF THE INVENTION

1. Field of the Invention

This invention relates to a method and apparatus for decoding an encoded signal obtained by orthogonal-transforming an input signal.

2. Description of the Related Art

There are a known variety of encoding methods in which audio signals inclusive of speech signals and acoustic signals are compressed by exploiting statistical properties of the audio signals in the time domain and in the frequency domain, as well as psychoacoustic characteristics of human beings. These encoding methods are roughly classified into encoding in the time domain, encoding in the frequency domain, and analysis synthesis encoding.

Video signals are often reproduced at speeds faster or slower than their recorded speed. It has been thought desirable that the speech signals associated with video signals be reproduced at a constant speed irrespective of the reproducing speed of the video signals. Ordinarily, if the speech signals are recorded synchronously with the video signals, and if the video signals are reproduced at one-half speed, the speech signals are also reproduced at one-half speed and, hence, are changed in pitch. Thus, it becomes necessary to perform signal compression along the time axis taking into account the zero-crossing point to restore the pitch of the speech signal to the pitch of the original signal at the standard reproducing speed.

High-efficiency speech encoding methods that perform time-axis processing as described above, for example, code excited linear prediction (CELP) encoding, allow fast modification along the time axis. Nevertheless, implementation of these methods has been difficult because of the large volume of processing operations required during decoding.

SUMMARY OF THE INVENTION

It is therefore an object of the present invention to provide a signal decoding method and apparatus whereby the speech signal reproducing speed can be controlled easily and resulting in high sound quality without changing the phoneme or pitch.

In one aspect, the present invention provides a signal decoding method including a residual determining step of finding linear or non-linear prediction residuals of an input signal, a transform step for performing an orthogonal transform on the linear or non-linear prediction residuals thus found for determining orthogonal transform coefficient data at a rate of N coefficients per transform unit, and a data number converting step for converting the number of orthogonal transform coefficients from N to M. Then, an inverse orthogonal transform step forms time-domain values based on the M coefficients and a predictive synthesis step performs predictive synthesis based on the linear or non-linear prediction residuals obtained by the inverse transform step.

With the present data decoding method, the number of orthogonal transform coefficients obtained by orthogonally transforming linear/non-linear prediction residuals of the input signal is converted in a data number converting step from N to M. That is, the number of coefficients is increased by a factor of M/N. The orthogonal transform coefficient data, converted into M/N-tuple data by the data number converting step is inverse orthogonal-transformed in the inverse orthogonal transform step. The inverse orthogonal-transformed linear/non-linear prediction residuals from the inverse transform step are synthesized in a synthesis step to form an output signal. The output signal reproducing speed is equal to N/M times the recording speed.

According to the signal decoding method of the present invention, the number of orthogonal transform coefficients supplied after short-term predictive analysis of the input signal and orthogonal transform of the resulting linear/non-linear prediction residuals is easily converted to a different number of data points. Therefore, control of the reproducing speed is relatively simple.

In another aspect, the present invention provides a signal decoding apparatus including means for finding linear or non-linear prediction residuals of an input signal and performing an orthogonal transform on the linear or non-linear prediction residuals thus found for determining orthogonal transform coefficients obtained at a rate of N coefficients per transform unit, data number converting means for converting the number of the orthogonal transform coefficients from N to M, inverse orthogonal transform means for inverse orthogonal transforming the M orthogonal transform coefficients obtained by the data number conversion means, and predictive synthesis means for performing predictive synthesis based on the linear or non-linear prediction residuals obtained by the inverse orthogonal transform means.

According to the present data decoding apparatus, the data number converting means converts the number of orthogonal transform coefficients obtained by orthogonally transforming linear/non-linear prediction residuals of the input signal, which are for example short-term prediction residuals or pitch residuals freed of pitch components, from N to M. Thus, the number of coefficients increases by a factor of M/N. The inverse orthogonal transform means transforms the orthogonal transform coefficients converted to M/N-tuple data by the data number converting means. The synthesis means synthesizes inverse orthogonal-transformed linear/non-linear prediction residuals from the inverse transform means to form an output signal. The result is that the output signal reproducing speed is N/M times the recording speed.

According to the present invention there is provided a signal decoding apparatus where the number of orthogonal transform coefficients supplied after short-term predictive analysis of the input signal and orthogonal transform of the resulting linear/non-linear prediction residuals, may be easily converted to a different number of coefficients by a simplified structure. Therefore, the reproducing speed can be controlled in a simple manner.

DESCRIPTION OF THE PREFERRED EMBODIMENTS

Figure 1:
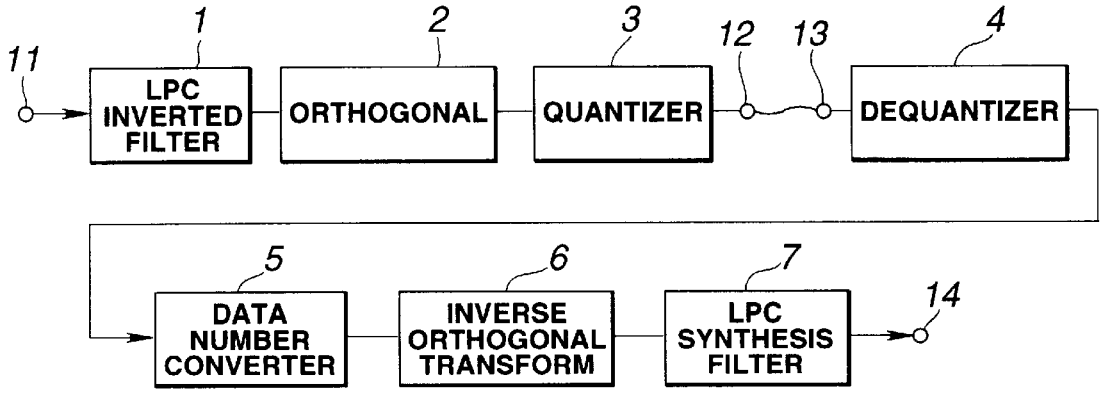
FIG. 1 is a block diagram showing an illustrative structure of a signal decoder and a signal encoder configured according to an embodiment of the present invention.

Referring to the drawings, preferred embodiments of the signal decoding method and apparatus of the present invention will be explained in detail.

Referring to FIG. 1, a signal decoding apparatus (decoder) includes a data number converter 5 for converting the number of orthogonal transform coefficients from N to M, an inverse orthogonal transform unit 6 for inverse orthogonal-transforming the M number of the orthogonal transform coefficients obtained by the data number converter 5, and a linear predictive coding (LPC) synthesis filter 7 for performing predictive coding based on the short-term prediction residuals obtained by the inverse orthogonal transform unit 6. In the signal decoder, linear/non-linear prediction residuals, for example, short-term prediction residuals, are found for the input signal and are orthogonal-transformed to form orthogonal transform coefficients at a rate of N coefficients per transform unit. This N number of orthogonal transform coefficients are supplied via a transmission signal input terminal 13 to the data number converter 5 via the dequantizer 4 and converted into M number of coefficients.

A signal encoding apparatus (encoder) for supplying data to the above-mentioned signal decoder is next explained.

A speech signal entering the input terminal 11 is filtered by the LPC inverted filter 1 with, for example, short-term predictive filtering using the linear predictive analysis (LPC) method, to find short-term prediction residuals. The output of the LPC inverted filter 11 are LPC residuals. These LPC residuals are orthogonal-transformed by the orthogonal transform unit 2. The orthogonal-transformed speech signal is quantized by the quantizer 3 and converted into a signal for transmission that is output from terminal 12. The quantized speech signal may be recorded on a recording medium or transmitted using a transmission system, such as an optical fiber.

Figure 2:
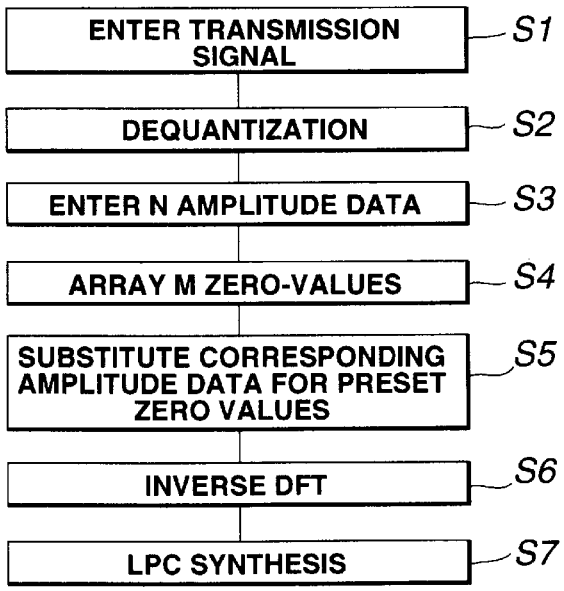
FIG. 2 is a flowchart for illustrating the detailed operation of a signal decoding method according to an embodiment of the present invention.

Before proceeding to a description of the signal decoder, the signal decoding method applied by the signal decoder will be explained with reference to the flowchart of FIG. 2.

Step S4 of the decoding method is a data number conversion step for converting the number of orthogonal transform coefficients from N to M. Step S6 is an inverse transform step for inverse transforming the M number of orthogonal transform coefficients obtained by the data number conversion step and step S7 is a synthesis step for performing predictive synthesis based on short-term prediction residuals obtained by the inverse orthogonal transform step. In the decoding method, linear/non-linear prediction residuals, for example, short-term prediction residuals, are found for the input signal and orthogonal-transformed to form orthogonal transform coefficients at a rate of N coefficients per transform unit. These orthogonal transform data are supplied to the data number converting step (step S4) where the number of orthogonal transform coefficients is converted from N to M.

It is assumed that, for discrete Fourier transform (DFT) pairs obtained by discrete Fourier transforming a signal, x(n), there exist data X(k), where n=0, . . . , N-1 and k=0, . . . , N-1.

In the signal decoding method of the present invention, X'(k) is represented by the following equation:

$$X'(k) = \begin{pmatrix} X\left(\frac{k}{l}\right) & (k = lm) \\ 0 & (k = lm + r,\ r = 1 \ldots l-1) \end{pmatrix} \tag{1}$$

$$\begin{aligned} x'(n+pN) &= \sum_{k=0}^{lN-1} X'(k)\exp\left(\frac{2\pi j}{lN}(lk(n+pN))\right) \\ &= \sum_{k=0}^{N-1} X'(lk)\exp\left(\frac{2\pi j}{N}(lk(n+pN))\right) \\ &= \sum_{k=0}^{N-1} X(lk)\left(\exp\left(\frac{2\pi j}{N}kn\right)\right)(\exp(2\pi jkp)) \\ &= x(n) \end{aligned} \tag{2}$$

The equation (2) specifies that x'(n) represents conversion of x(n) with a period N and with n=0, . . . , N-1.

If the N number of orthogonal-transform coefficients or amplitude data X(k) formed, for example, by a DFT, are increased or decreased to a number M by mapping and then inverse orthogonal-transformed, for example, by an inverse DFT, a waveform having an M/N-tuple duration is obtained. By overlap-adding the resulting waveform, it becomes possible to reproduce the speech signal with an M/N-tuple time duration but with unchanged pitch.

In the present signal decoding method, the transmission signal enters the transmission signal input terminal 13 at step S1. The transmission signal is dequantized at step S2. Then, at step S3, N orthogonal transform coefficients obtained by dequantization, are extracted.

At step S4, the amplitude data is cleared to zero and zero-values are added or eliminated to produce a target number of data points M. In other words, the number of data points M becomes equal to M/N times the number of original coefficients N. The M data points thus prepared are termed C(h).

At step S5, the zero-values at positions in the set of M zeros satisfying conditions explained below are replaced with corresponding amplitude data X(k).

The C(h) values to be replaced by corresponding X(h) values satisfy the following equation:

$$C\left(\left\lfloor \frac{M}{N} \cdot h + 0.5 \right\rfloor\right) = C(h) \tag{3}$$

where the function ⌊ ⌋ rounds the enclosed value up to the next highest integer. The values of the amplitude data X(k) are unchanged.

In equation (3), the post-substitution amplitude data C' is substituted for the pre-substitution amplitude data C. As the amplitude data C' is replaced with corresponding amplitude data X.

As a first example, suppose M/N=1.5. Initially each element of the array C(h) is set to zero, where h=0 . . . M/N*(N-1). The condition of equation (3) is applied to determine which values of X(k) will be substituted for C(h) where h=⌊k*(M/N)⌋. The C(h) values satisfying equation (3) are:

C(0), C(2), C(3), C(5) . . . C((M/N)*(N-1))

Figure 3:
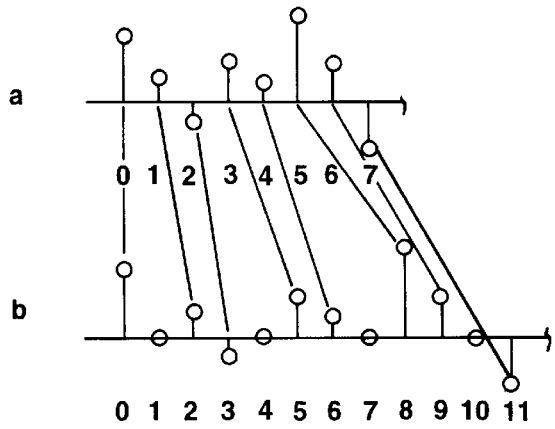
FIG. 3 illustrates a data conversion step in the signal decoding method according to an embodiment of the present invention.

For each C(h) value satisfying equation (3), the corresponding X(k) value is substituted. Note, for C(h) that do not satisfy equation (3), for example C(1 ), C(4), these values remain zero. The values at a and b in FIG. 3 show the results of this substitution.

Figure 4:
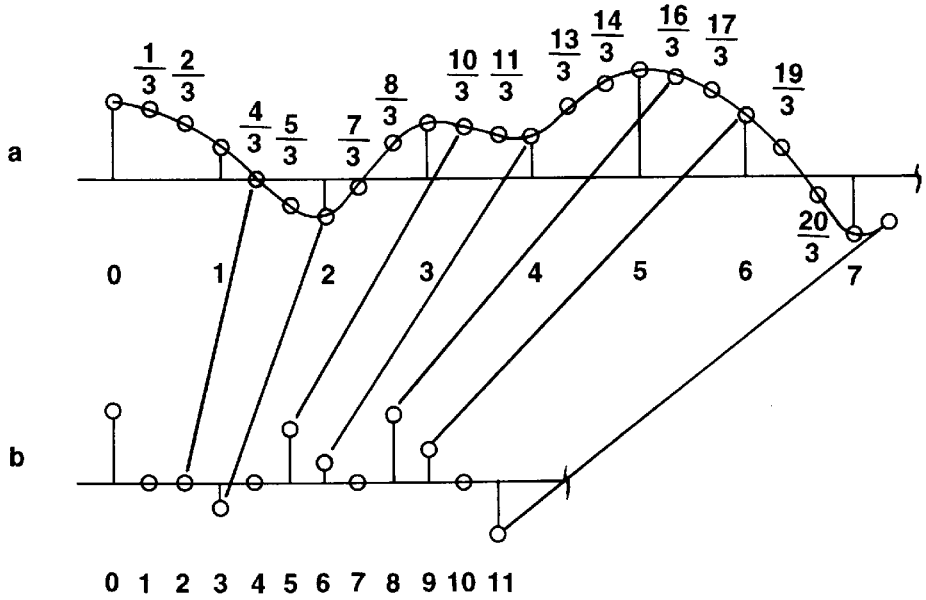
FIG. 4 illustrates a data conversion step in the signal decoding method according to an embodiment of the present invention.

The values at a and b in FIG. 4 represent a second example where M/N=1/1.5. Here the output array C(h) is smaller than the input array X(k). Therefore, X(k) is oversampled compared with the output array C(h), as shown in FIG. 4(*a*).

Again, values of C(h) satisfying equation (3) are substituted with the corresponding X(k) values.

Thus,

C(2)=X(⌊2*1/1.5⌋)=X(⌊4/3⌋)

C(3)=X(⌊3*1/1.5⌋)=X(⌊3⌋)

as shown in FIG. 4(*b* ).

After converting the number of amplitude data points from N to M, processing transfers to step S6 where M amplitude data points are inverse DFTed and transformed into time-domain signals. At step S7, time-domain signals obtained by inverse DFT processing are used for synthesizing speech signals by LPC synthesis. The resulting speech signals are output.

If M/N=1.5, the speech signals obtained after data number conversion contain a number of data points that is 1.5 times the number of data points for the input speech signal. Therefore, the playback speed is lowered by a factor equal to the reciprocal of 1.5, 1/1.5=0.67. Reproduction speed is slowed by ⅓ or approximately 33%.

The signal decoder will now be explained in the following, in which the operations of the signal decoding apparatus shown in FIG. 1 are correlated to the step numbers in FIG. 2.

In FIG. 1, the dequantizer 4 dequantizes the quantized transmission signal entering the transmission signal input terminal 13 (step S2) to output N amplitude data points (step S3).

The data number converter 5 converts the N amplitude data points supplied from the dequantizer 4 to M amplitude data points by the above-described number converting method (steps S4 and S5) and outputs the M amplitude data points to the inverse orthogonal transform unit 6.

The inverse orthogonal transform unit 6 inverse orthogonal-transforms the M amplitude data points at step S6 to find LPC residuals. The LPC synthesis filter 7 synthesizes the LPC residuals at step S7 to produce speech signals that are sent to an output terminal 14.

Figure 5:
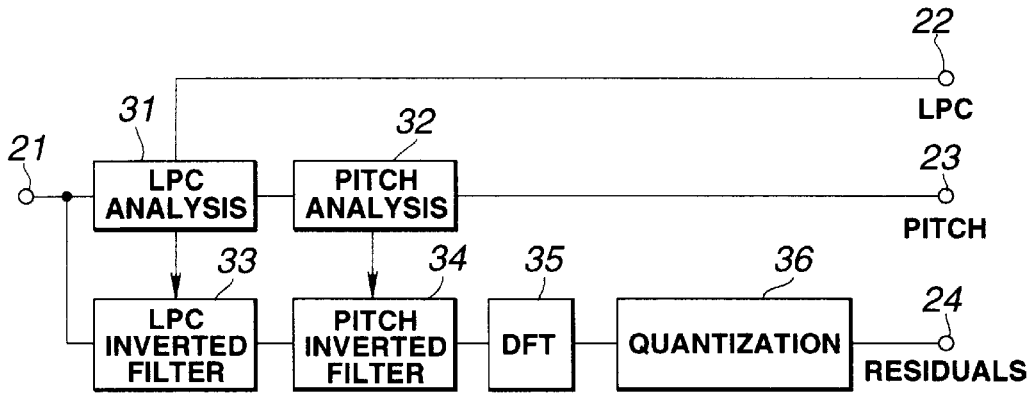
FIG. 5 is a block diagram showing a detailed structure of a signal encoder according to an embodiment of the present invention.
Figure 6:
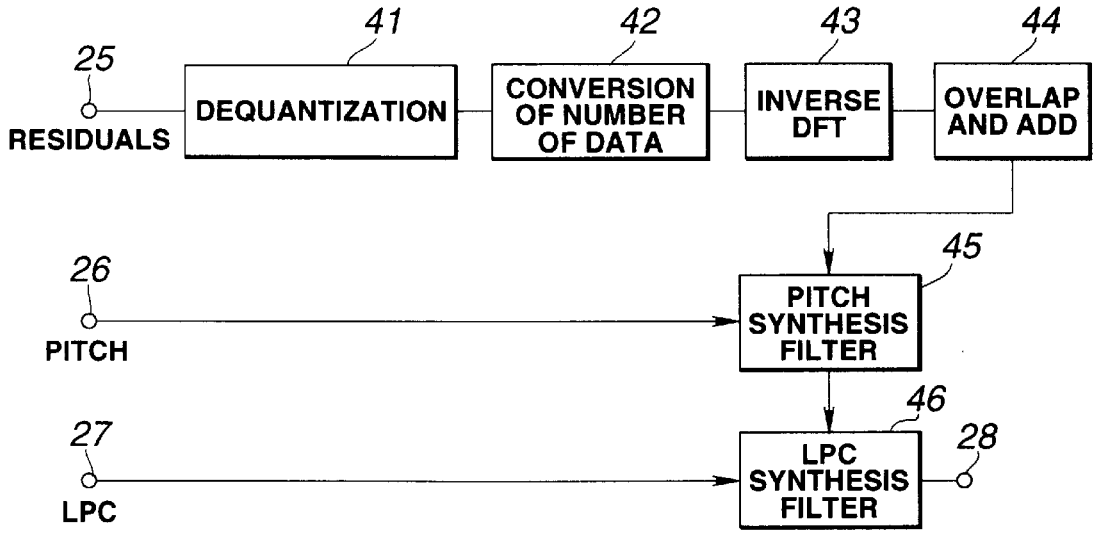
FIG. 6 is a block diagram showing a detailed structure of a signal decoder according to an embodiment of the present invention.

FIG. 5 is a more detailed example of the signal encoder, and FIG. 6 is a more detailed example of the signal decoder.

In FIGS. 5 and 6, the signal encoder first finds the linear/non-linear prediction residuals of the input signal, the LPC and pitch residuals freed of the LPC components and the pitch components. These LPC and pitch residuals are then orthogonal-transformed, using, for example, DFT, to produce orthogonal transform coefficients. The signal decoder then performs pitch component prediction and LPC prediction based on LPC and pitch residuals found from the inverse DFT and synthesizes the output signal.

Referring to FIG. 5, a speech signal entering the input terminal 21 (input signal) is sent to an LPC analysis unit 31 and to an LPC inverted filter 33.

The LPC analysis unit 31 performs a short-term linear prediction of the input signal and outputs an LPC parameter specifying the predicted value to the LPC output terminal 22, to the pitch analysis unit 32 and to the LPC inverted filter 33. The LPC inverted filter 33 outputs LPC residuals obtained by subtracting the predicted values of the LPC parameters from the input signal, to the pitch inverted filter 34.

Based on the LPC parameters, the pitch analysis unit 32 performs auto-correlation analysis to extract the pitch of the input signal and sends the pitch data to the pitch output terminal 33 and to the pitch inverted filter 34. The pitch inverted filter 34 subtracts the pitch component from the LPC residuals to produce LPC and pitch residuals which are then sent to the DFT unit 35.

The DFT unit 35 orthogonal-transforms the LPC and pitch residuals. In the present embodiment, DFT is used as an example of an orthogonal transform, however, other orthogonal transform methods might be used.

The amplitude data, produced by DFTing the LPC and pitch residuals are sent to a quantization unit 36. The quantization unit 36 then quantizes the amplitude data and sends the quantized amplitude data to a residual output terminal 24. The number of amplitude data points is N.

The LPC parameters output at the LPC output terminal 22, the pitch data output at the pitch output terminal 23, and transmission data output at the residual output terminal 24 are recorded on a recording medium (not shown) or transmitted over a transmission channel so as to be routed to the signal decoder, as shown in FIG. 1.

In the data decoder, shown in FIG. 6, the transmission data-that was sent from the residual output terminal 24 of the encoder is received by the residual input terminal 25. The transmission data is dequantized by a dequantizer 41, is converted into amplitude data, and is routed to the data number converter 42.

The data number converter 42 converts the number of the amplitude data points from N to M by the above-described number converting method. The M amplitude data points are sent to the inverse DFT unit 43.

The inverse DFT unit 43 transforms the M amplitude data points by inverse DFT to find LPC and pitch residuals that are sent to the overlap-and-add unit 44. The number of LPC and pitch residual data points is M/N times the number of LPC and pitch residual data points output by the pitch inverted filter 34.

The overlap-and-add unit 44 overlap-adds the LPC and pitch residuals between neighboring blocks to produce LPC and pitch residuals containing reduced distortion components. These residuals are sent to the pitch synthesis filter 45.

Based on the pitch data received at the pitch input terminal 26, the pitch synthesis filter 45 calculates the pitch and sends the LPC residuals containing the pitch components to the LPC synthesis filter 46.

Based on the LPC parameters, the LPC synthesis filter performs short-term prediction synthesis of speech signals and sends the resulting speech signal to the output terminal 28.

The speech signal, sent to the output terminal 28, is derived from a number of data points on the frequency axis that is M/N times that of the input signal. Thus, the playback time for the output speech signal will be M/N times as long as that for the input signal, and playback speed is lowered by a factor of N/M.

Figure 7:
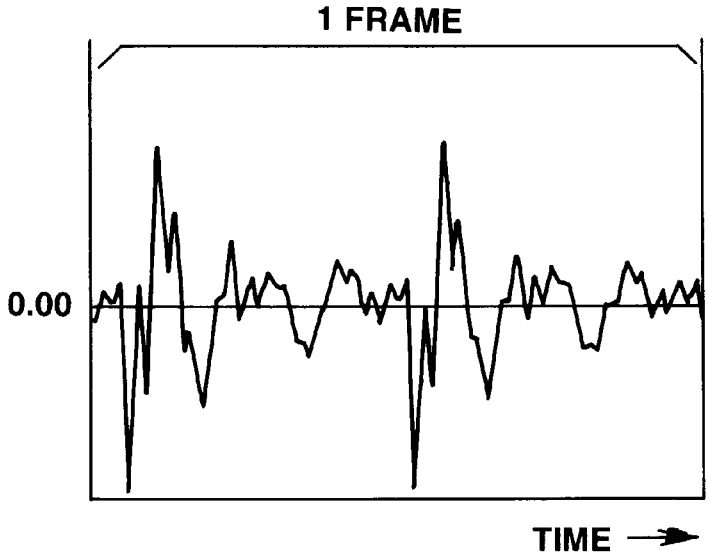
FIG. 7 illustrates an example of a speech signal entering the speech encoder.
Figure 8:
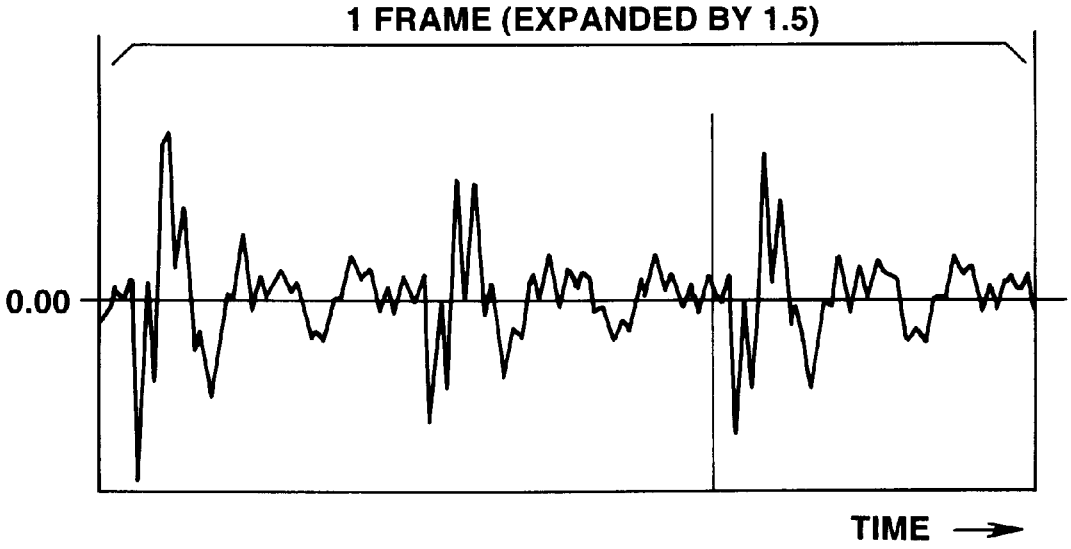
FIG. 8 illustrates a speech signal after processing by the signal decoder.

FIGS. 7 and 8 show an example of a speech signal before and after having been processed by the above-described signal encoder and signal decoder. FIG. 7 shows the input signal on the time axis prior to the encoding and decoding methods described above. The speech signal has 160 samples per frame. FIG. 8 shows the signal after inverse orthogonal transform by the signal decoder and after data number conversion.

FIGS. 7 and 8 indicate that, after the number of orthogonal transform coefficients is increased by a factor of 1.5 by data number conversion and the coefficients are then inverse orthogonal-transformed, the number of samples is increased by a factor of 1.5. After processing, the speech signal contains 240 samples per frame.

The present invention is not limited to the illustrative embodiments of the signal decoding method and apparatus described above, but may comprise various modifications.

For example, the orthogonal transform method may be a discrete cosine transform, instead of a discrete Fourier transform.

The rate of data number conversion M/N may be any arbitrary number instead of 1.5, as described above. If the ratio M/N is larger than 1, the data number is increased thus decreasing the playback speed. Whereas, if the ratio M/N is smaller than 1, the number of data points is decreased and the playback speed is increased.

The linear/non-linear analysis performed before calculation of orthogonal transform coefficient data may utilize a prediction analysis method other than short-term prediction and pitch analysis as described above.

Figure 9:
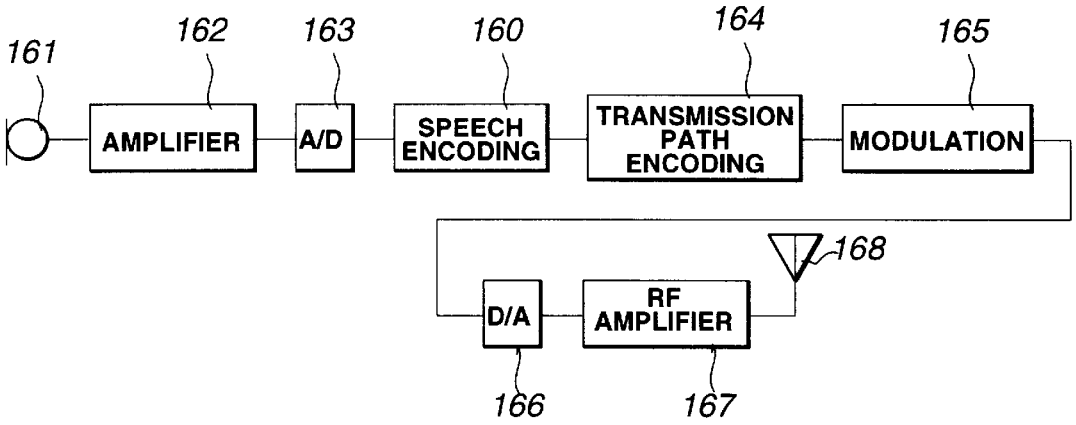
FIG. 9 is a block diagram showing a transmitter of a portable terminal employing the speech encoder according to an embodiment of the present invention.
Figure 10:
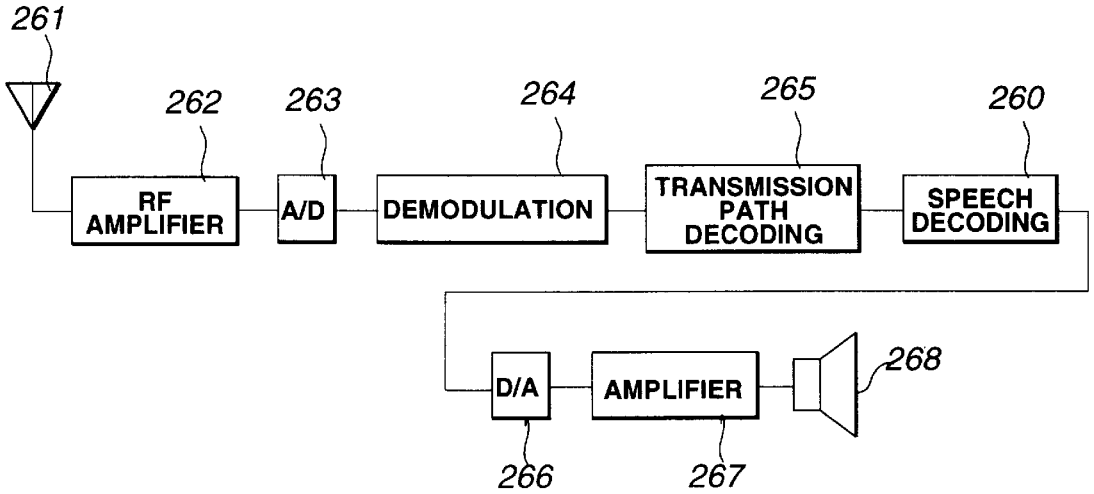
FIG. 10 is a block diagram showing a receiver of a portable terminal employing the speech decoder according to an embodiment of the present invention.

The above-described signal encoder and signal decoder may be used as a speech codec in, for example, a portable communication terminal or a portable telephone, as shown in FIGS. 9 and 10.

FIG. 9 shows a configuration of a portable terminal employing a speech encoding unit 160 having the configuration as shown in FIG. 1. The speech signal collected by the microphone 161 of FIG. 9 is amplified by the amplifier 162 and converted by the A/D converter 163 into a digital signal which is sent to the speech encoding unit 160. The speech encoding unit 160 has the configuration shown in FIG. 1. A digital signal from the A/D converter 163 enters the input terminal 101. The speech encoding unit performs encoding as explained in connection with FIG. 1 so that an output signal from each of the output terminals of FIG. 1 is sent to the transmission path encoding unit 164 that performs channel encoding. An output signal of the transmission path encoding unit 164 is sent to the modulation circuit 165 for modulation and sent via the D/A converter 166 and the RF amplifier 167 to the antenna 168.

FIG. 10 shows the configuration of the reception side of a portable terminal employing the speech decoding unit 260 configured as shown in FIG. 5. The speech signal received by the antenna 261 of FIG. 10 is amplified by the RF amplifier 262 and sent via the A/D converter 263 to the demodulation circuit 264. The resulting demodulated signal from the demodulating unit 264 is sent to the transmission path decoding unit 260 configured as shown in FIG. 5. The signal from the output terminal 201 of FIG. 5 is sent to the D/A converter 266 in FIG. 10. An analog speech signal from the D/A converter 266 is sent to the speaker 268.

It is understood, of course, that the preceding description is presented by way of example only and is not intended to limit the spirit or scope of the present invention, which is to be defined only by the appended claims.

We claim:

1. A method for modifying a signal comprising the steps of:

receiving an input signal;

dividing said input signal into a set of time segments to create signal units;

performing a time-domain compression operation on said signal units;

performing an orthogonal transform on said compressed signal units in the time domain to yield a set of N transform coefficients per signal unit in the frequency domain;

converting said set of N transform coefficients into a set of M values;

performing an inverse orthogonal transform on said set of M values to create time-domain signal values; and synthesizing an output signal based on said time-domain signal values, whereby said output signal corresponds to said input signal at a modified playback speed, wherein said step of converting comprises rearranging each of said N transform coefficients on the frequency axis without changing respective magnitudes of said coefficients.

2. The signal modifying method according to claim 1 wherein said step of performing a time-domain compression operation comprises:

finding short-term prediction values;

selecting a signal unit of said input signal; and computing residual values based on a difference between said prediction values and said signal unit of said input signal; and wherein said step of synthesizing an output signal comprises predictive synthesis of said time-domain signal values.

3. The signal modifying method according to claim 1 wherein said step of rearranging said N transform coefficients on the frequency axis comprises:

multiplying each of said N coefficients on the frequency axis by a factor M/N; and assigning said coefficients a new frequency value based on a result of said step of multiplying.

4. The signal modifying method according to claim 1 wherein said converting step further comprises the steps of:

oversampling of said set of N transform coefficients; and defining said set of M values based on said oversampling.

5. An apparatus for modifying a signal comprising:

signal input means for receiving an input signal;

dividing means connected to said signal input means for dividing said input signal into signal segments;

time-domain compression means connected to said dividing means for creating a compressed signal based on said signal segments and including predictive means connected to said input means for forming a predicted value based on said input signal; and residual forming means connected to said predictive means and to said input means for computing a residual value based on a difference between said predicted value and a signal segment of said input signal;

orthogonal transform means connected to said time-domain compression means for performing an orthogonal transform on said compressed signal in the time domain to yield a set of N transform coefficients for each of said signal segments in the frequency domain;

converting means connected to said orthogonal transform means for converting said set of N transform coefficients to a set of M values;

inverse orthogonal transform means connected to said converting means for creating a set of time-domain signal values based on said set of M values; and synthesis means connected to said inverse orthogonal transform means for creating an output signal based on said set of time-domain signal values and including predictive synthesis means for forming said output signal based on a recovered residual value found by said inverse orthogonal transform means, wherein said converting means comprises rearrangement means for rearranging each of said N transform coefficients on the frequency axis without changing respective magnitudes of said coefficients.

6. The signal modifying apparatus according to claim 5 wherein said converting means further comprises:

multiplication means for multiplying each of said N coefficients on the frequency axis by a factor M/N; and assignment means connected to said multiplication means for assigning each of said N coefficients a new frequency position based on results of said multiplication means.

7. The signal modifying apparatus according to claim 5 wherein said converting means further comprises:

oversampling means for oversampling said set of N transform coefficients; and defining means connected to said oversampling means for defining said set of M values based on said oversampling.

8. A portable radio terminal apparatus comprising:

input means for receiving a speech signal;

speech-encoding means connected to said input means for encoding said speech signal to create an encoded signal; and radio transmission means connected to said speech-encoding means for transmitting said encoded signal, wherein said speech encoding means includes:

dividing means connected to said input means for dividing said speech signal into signal segments;

time-domain compression means connected to said dividing means for creating a compressed signal based on said signal segments;

orthogonal transform means connected to said time-domain compression means for creating a set of N transform coefficients in the frequency domain for each signal segment in the time domain to create said encoded signal; and the apparatus further comprising:

and the apparatus further comprising:

radio receiving means responsive to said radio transmission means for receiving said encoded signal;

speech-decoding means connected to said receiving means for converting said encoded signal to a speech-decoded signal; and synthesis means connected to said speech-decoding means for creating a speech output signal, wherein said speech-decoding means includes:

commander means connected to said receiving means for increasing or deceasing said set of N transform coefficients to a set of M values;

inverse orthogonal transform means connected to said commander means for creasing a set of time-domain signal values based on said set of M values; and synthesis means connected to said inverse orthogonal transform means for creating said speech-decoded signal based on said set of time-domain signal values.

9. The radio terminal apparatus of claim 8 wherein said input means comprises:

amplifier means connected to said input means for amplifying said speech signal; and analog to digital converting means connected to said amplifier means for digitizing said speech signal.

10. The radio apparatus according to claim 8 wherein said radio transmission means comprises:

transmission path encoding means connected to said speech-encoding means for channel-encoding said speech signal;

modulation means connected to said transmission path encoding means for modulating said speech signal;

digital to analog converting means connected to said modulation means for converting said speech signal to an analog signal; and radio broadcast means connected to said digital to analog converting means for transmitting said speech signal.

11. The radio terminal apparatus of claim 8 wherein said radio receiving means comprises:

amplifier means for amplifying said received speech signal;

analog to digital converting means connected to said amplifier means for digitizing said received speech signal;

demodulation means connected to said analog to digital means for demodulating said speech signal; and transmission path decoding means connected to said demodulation means for channel-decoding said speech signal to produce said speech-encoded signal.

* * * * *